United States Patent [19]

Lipschutz

[11] 4,409,807

[45] Oct. 18, 1983

[54] MASTER-KEY PISTON LOCK

[75] Inventor: Paul Lipschutz, Croissy, France

[73] Assignee: Sodex-Magister Societe d'Exploitation des Brevets Neiman, Croissy, France

[21] Appl. No.: 282,572

[22] Filed: Jul. 13, 1981

[30] Foreign Application Priority Data

Jul. 23, 1980 [FR] France ..... 80 16187

[51] Int. Cl.[3] ..... E05B 19/06; E05B 27/04; E05B 35/10

[52] U.S. Cl. ..... 70/340; 70/337; 70/364 A; 70/409

[58] Field of Search ..... 70/337, 340, 364 A, 70/409, 359, 378, 419

[56] References Cited

U.S. PATENT DOCUMENTS

| | | | |
|---|---|---|---|
| 420,174 | 1/1890 | Taylor | 70/340 |
| 446,192 | 2/1891 | Sargent | 70/340 |
| 588,026 | 8/1897 | Stadtmuller | 70/340 |
| 806,361 | 12/1905 | Pickop | 70/340 |
| 3,412,588 | 11/1968 | Schwegler | 70/364 A |
| 4,137,739 | 2/1979 | Keller | 70/364 A X |
| 4,343,166 | 8/1982 | Hofmann | 70/409 X |

FOREIGN PATENT DOCUMENTS

| | | | |
|---|---|---|---|
| 1462932 | 11/1966 | France | 70/409 |
| 71007 | 11/1915 | Switzerland | 70/337 |

*Primary Examiner*—Cornelius J. Husar
*Assistant Examiner*—Lloyd A. Gall
*Attorney, Agent, or Firm*—Dowell & Dowell

[57] ABSTRACT

The invention relates to a master-key piston lock comprising a cylindrical rotor pivoting in a bore of a stator, the said stator comprising radial holes opening into the said bore and in each of which there slides a stator piston spring-loaded towards the said bore, the said rotor comprising an axial key passage into which there open radial holes open at their other extremities at the peripheral surface of the rotor, a right circular-cylindrical rotor piston sliding in each of the said radial holes of the rotor and a key equipped with coded notches co-operating each with the inner extremity of one of the said stator pistons in such manner that the outer extremity of each of the rotor pistons is flush with the peripheral surface of the rotor.

The rotor pistons comprise a shoulder with which there can co-operate the notches of a master key.

1 Claim, 3 Drawing Figures

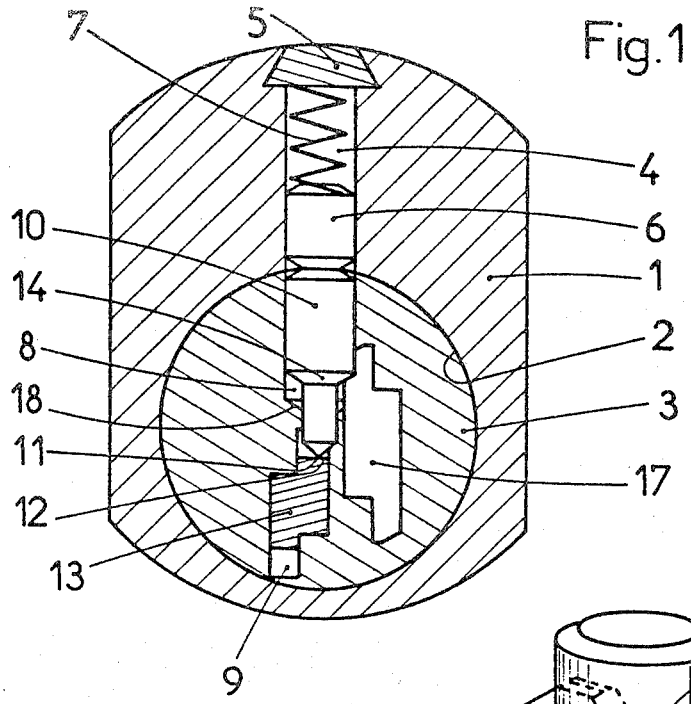
Fig. 1
Fig. 3
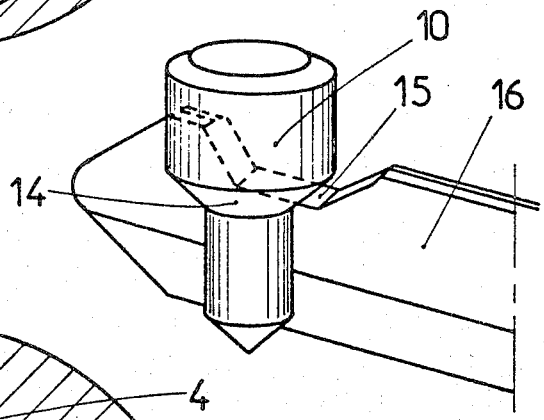
Fig. 2
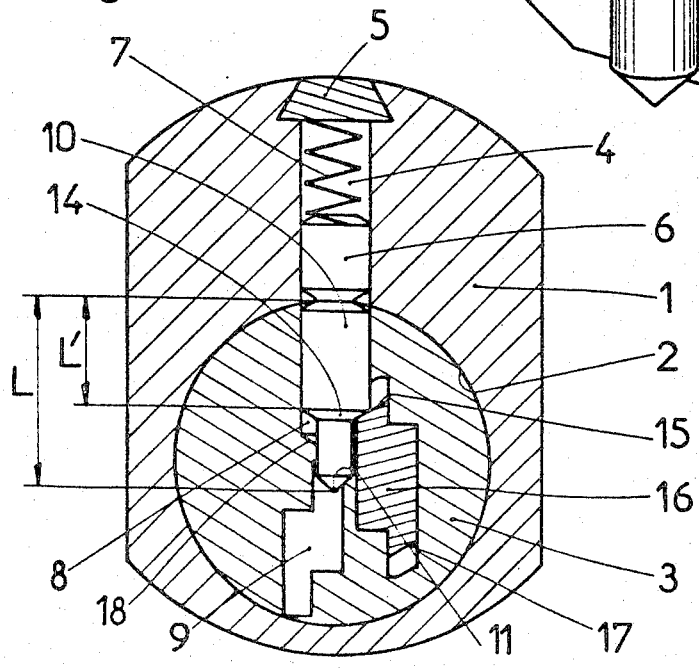

MASTER-KEY PISTON LOCK

BACKGROUND TO THE INVENTION

The present invention relates to a piston lock usable with two different keys. This type of lock, normally called master-key lock, permits the normal user to open the lock with one of the keys, while the second key, which is identical for a series of locks and constitutes the master key, is used by a different key holder to open the locks of the series.

STATEMENT OF PRIOR ART

To solve this problem numerous solutions have been proposed which are all complicated and burdensome. One of these solutions consists in dividing each stator piston in two in such manner as to permit unlocking for two positions of each rotor piston, corresponding to two different combinations one of which is identical for all the locks of one and the same series. The construction of this master-key lock is complicated by the fact of the increase of the number of pistons. Moreover the number of combinations utilisable is reduced by the reduction of the effective stroke of the rotor pistons.

It has also been proposed (see British Pat. No. 945,792) to utilise flat rotor pistons the inner extremity of which, entering the key passage, comprises two distinct notches intended each to co-operate with a distinct key, one of which constitutes the master-key. If this solution is of simpler construction than the previous, it nevertheless has the drawback of giving a complicated form to the rotor pistons, considerably increasing the price of the lock.

OBJECT OF THE INVENTION

The present invention aims at obtaining a master-key piston lock, the fitting of which is identical with that of the traditional lock and the cost price of which is practically the same.

SUMMARY OF INVENTION

According to the invention there is provided a master-key lock and a notched master key comprising:

a stator having a cylindrical rotor bore therein, which stator is provided with radial holes opening into the rotor bore, stator pistons provided respectively in the radial holes in said stator and being spring-loaded towards said rotor bore, a cylindrical rotor rotatable in the rotor bore of said stator, said rotor having radial holes for axial alignment respectively with the radial holes in the stator, each radial hole in said rotor having a first portion having a diameter corresponding to the diameter of the radial holes in the stator and a second portion of smaller diameter, a first axial key passage into which there open extremities of the second portions of said radial holes in the rotor, and a second key passage separate from said first axial key passage into which second key passage there opens a peripheral portion of each of said first portions of the radial holes in the rotor, and right circular cylindrical rotor pistons slidable respectively in the radial holes of the rotor, each rotor piston having a first portion having a sliding fit in the first portion of the corresponding radial hole and a second portion having a sliding fit within the second portion of said corresponding radial hole, said rotor pistons each having a frusto-conical shoulder between said first and second portions thereof with which shoulder there can co-operate the notches of the master-key, the floors of the key notches being inclined to the plane of the master-key at the same angle as said shoulders, whereby on insertion into said first key passage of a key equipped with appropriate coded notches the latter co-operate with the inner extremities of said rotor pistons in such manner that the outer extremity of each of the rotor pistons is flush with the peripheral surface of the rotor thus permitting rotation of the rotor and on alternative insertion of a notched master-key into said second key passage, the notches of the master-key cooperate with the shoulders on said rotor pistons to bring the latter in alignment with the rotor periphery to permit rotation of the rotor.

In one advantageous form of embodiment the steps of the rotor pistons are frusto-conical and the notches of the master key are inclined parallel with the said steps.

BRIEF DESCRIPTION OF DRAWING

The invention will be clearly understood on reading of the following description given with reference to the accompanying drawing, wherein:

FIG. 1 is a diametrical sectional view of a lock according to one example of embodiment of the invention, with the normal key introduced;

FIG. 2 is analogous with FIG. 1, but with the master key introduced, and FIG. 3 is a perspective view of a portion of the master key according to FIG. 2, co-operating with a rotor piston.

DESCRIPTION OF PREFERRED EMBODIMENTS

The lock comprises a stator 1 equipped with a longitudinal bore 2 in which there pivots a cylindrical rotor 3. The stator 1 comprises a series of radial holes 4 opening into the bore 2 and closed at their opposite extremities by a small plate 5. Each hole 4 contains a stator piston 6 loaded towards the bore 2 by a spring 7 bearing upon the plate 5.

The rotor 3 comprises a series of radial holes 8 opening into a key passage 9 and open at the periphery of the rotor. A right circular-cylindrical piston 10 slides in each of the holes 8 and its lower extremity 11 co-operates with a notch 12 of a normal key 13 pushed into the key passage 9. The length L (FIG. 2) of each rotor piston 10 is such that, when the correct key 13 is inserted (FIG. 1), the extremity of the piston 10 opposite to its extremity 11 is flush with the peripheral surface of the rotor 3, which permits rotation of this rotor 3 in the bore 2.

According to the invention each rotor piston 10 comprises a step 14 with which there co-operate the notches 15 of a master key 16. The length L′ of each piston 10 between the step 14 and the extremity opposite to the extremity 11 is such that, when the correct master key 16 is introduced (FIG. 2), the rotor pistons 10 are flush with the peripheral surface of the rotor 3.

The variations of the length L of the different pistons supply the normal key combinations, as for an ordinary lock, so that it is the total length of the rotor pistons 10 which can be utilised to obtain these combinations, which are thus equal in number to those of an ordinary lock utilising rotor pistons of the same length. The variation of the lengths L′ supplies the master-key combination which is the same for a series of locks.

In the form of embodiment as represented the master key 16 slides in a longitudinal key passage 17 distinct from the passage 9. A peripheral portion of each axial hole 8 of the rotor opens into the passage 17 so that a portion of each notch 14 slides in the passage 17.

Furthermore the steps 14 are frusto-conical and the notches 15 are inclined parallel with the steps 14. This characteristic renders picking of the lock through the key passage 17 more difficult and permits increasing of the number of master-key combinations by varying the slopes of the steps 14.

Like the pistons of normal locks, the rotor pistons 10 are manufactured by turning, the steps 14 being utilised to co-operate with stops 18 formed at the junction between each radial hole 8 and the key passage 9, to limit the inward displacement of the rotor pistons 10.

The mechanical strength of the locks according to the invention is the same as that of a conventional lock utilising pistons of the same diameter without step, since the heads of the rotor pistons 10, which can penetrate into the holes 4 of the stator when an incorrect key is inserted, are not reduced in size.

I claim:

1. In combination a master-key lock and a notched master key comprising:

(a) a stator having a cylindrical rotor bore therein, which stator is provided with radial holes opening into the rotor bore, (b) stator pistons provided respectively in the radial holes in said stator and being spring-loaded towards said rotor bore, (c) a cylindrical rotor rotatable in the rotor bore of said stator, said rotor having radial holes for axial alignment respectively with the radial holes in the stator, each radial hole in said rotor having a first portion having a diameter corresponding to the diameter of the radial holes in the stator and a second portion of smaller diameter, a first axial key passage into which there open extremities of the second portions of said radial holes in the rotor, and a second key passage separate from said first axial key passage into which second key passage there opens a peripheral portion of each of said first portion of the radial holes in the rotor, and (d) right circular cylindrical rotor pistons slidable respectively in the radial holes of the rotor, each rotor piston having a first portion having a sliding fit within the first portion of corresponding radial hole and a second portion having a sliding fit within the second portion of said corresponding radial hole, said rotor pistons each having a frusto-conical shoulder between said first and second portions thereof with which shoulder there can co-operate the notches of the master-key, the floors of the key notches being inclined to the plane of the master key at the same angle as said shoulders, whereby on insertion into said first key passage of a key equipped with appropriate coded notches the latter co-operate with the inner extremities of said rotor pistons in such manner that the outer extremity of each of the rotor pistons is flush with the peripheral surface of the rotor thus permitting rotation of the rotor and on alternative insertion of a notched master-key into said second key passage the notches of the master-key co-operate with the shoulders on said rotor pistons to bring the latter in alignment with the rotor periphery to permit rotation of the rotor.

* * * * *